US005279279A

United States Patent [19]

White

[11] Patent Number: 5,279,279

[45] Date of Patent: Jan. 18, 1994

[54] DEFLECTOR DEVICE FOR DOWN-DRAFT COOKING RANGE VENTILATOR

[75] Inventor: Roger D. White, Warrenton, Va.

[73] Assignee: WLCR, Inc., Warrenton, Va.

[21] Appl. No.: 23,441

[22] Filed: Feb. 26, 1993

[51] Int. Cl.[5] ..... F24C 15/20

[52] U.S. Cl. ..... 126/299 D; 126/299 R; 126/214 D

[58] Field of Search ..... 126/214 D, 299 D, 299 R

[56] References Cited

U.S. PATENT DOCUMENTS

| | | |
|---|---|---|
| 2,674,991 | 4/1954 | Schaefer . |
| 3,011,492 | 12/1961 | Humbert . |
| 3,409,005 | 11/1968 | Field . |
| 3,559,636 | 2/1971 | Marino . |
| 3,712,819 | 1/1973 | Field . |
| 4,237,856 | 12/1980 | Trombatore . |
| 5,062,410 | 11/1991 | Sarnosky et al. . |
| 5,078,122 | 1/1992 | Kalenian . |

FOREIGN PATENT DOCUMENTS

| | | |
|---|---|---|
| 3503236 | 7/1986 | Fed. Rep. of Germany . |
| 0014015 | 1/1988 | Japan . |

*Primary Examiner*—Carroll B. Dority
*Attorney, Agent, or Firm*—Shlesinger, Arkwright & Garvey

[57] ABSTRACT

An adjustable deflector device is provided for selective positioning above the ventilator of a cooking range of the type where the ventilator is disposed adjacent to and flush with the cooking range heating elements. The deflector device comprises support means having first and second ends, the first end includes a first support portion and the second end includes a second support portion. The first and second portions are disposed at an angle with respect to each other. The first end is movably attached to the cooking range so that the first support portion is positioned at an angle with respect to the range. The first support portion is rotatable and extendable about its longitudinal axis. The second support portion includes a deflector portion having a width at least equal to the exhaust means and a length substantially equal to the exhaust means. The deflector portion is rotatable and extendable about its longitudinal axis so that the deflector may be selectively positioned above the exhaust means to deflect airborne matter or cooking vapors into the exhaust means in a more efficient manner.

20 Claims, 2 Drawing Sheets

DEFLECTOR DEVICE FOR DOWN-DRAFT COOKING RANGE VENTILATOR

FIELD OF THE INVENTION

The present invention relates to a deflector device for a suction exhaust or ventilator of a cooking range and more particularly for a suction exhaust or ventilator of the down-draft type which removes cooking heat and vapor from the cooking range in a downwardly direction through the cooking range unit.

BACKGROUND OF THE INVENTION

A common type of cooking unit designed for domestic use is the cooking range wherein electrical resistor or gas burner heater units are mounted in a counter top within a kitchen area of a home. Numerous apparatus' have been devised for providing ventilation of the vapors generated during cooking on such units. For example, a hood may be positioned over the cooking unit to draw off effluents such as smoke, heat, vapor, grease or other particles generated during cooking. The aforementioned range hoods provide effective ventilation since their positioning above the cooking unit compliments the natural convection of the cooking effluents. However, the size and bulkiness of the hood often make it less aesthetically pleasing within a domestic kitchen.

A more recent approach is to mount the ventilator or suction means beside or within the cooking unit so that the ventilator opening receiving the cooking effluents is flush with the surface of the cooking range unit. Typical of such cooking ranges are U.S. Pat. No. 3,596,650 and U.S. Pat. No. 3,474,724 assigned to the Jenn-Aire Corporation of Indianapolis, Ind. This "down-draft" cooking range ventilator possesses the advantage of both compactness and aesthetic appeal to the consumer. However such down-draft ventilators do suffer from a number of disadvantages. For example, although smoke, particles and other fumes are mostly removed from the general area surrounding the cooking range during cooking, there still exists visible as well as invisible flow of vaporized grease or particles that are not sufficiently pulled within the suction inlet of the ventilator. Consequently, if the fumes containing the grease and smoke are excessive, the down-draft ventilator is insufficient to withdraw all of the effluent into the suction inlet for discharge. Smoke and fumes which escape the ventilator are often then deposited along the ceiling and walls of the kitchen or in the area immediately adjacent the stove. Over a period of time, such deposits can accumulate causing a problem which is not only unsightly and requires extensive clean up, but is also a potential fire and health hazard. Present attempts to remedy the problem have relied upon installation of an electric motor which is sufficiently powerful to remove all the vapors generated during cooking. This approach has almost always fallen short of expectations.

OBJECTS AND SUMMARY OF THE INVENTION

It is therefore an object of the present invention to provide a deflector device for a down-draft type cooking range which improves the efficiency of the ventilator in removing smoke, heat or other airborne particles and grease.

Yet another object of the present invention is to provide a deflector device for a down-draft type cooking stove that can be adjusted in four different directions to improve ventilator efficiency.

Another object of the present invention is to provide a deflector device which improves the efficiency of a conventional down-draft ventilator by deflecting and increasing flow across the range surface into the ventilator.

Still another object of the present invention is to provide a deflector device for a down-draft type range stove which includes a variety of deflector shield shapes that may be interchangeably used.

Yet another object of the present invention is to provide a deflector device for a down-draft type range stove which can be adjusted during cooking.

Still a further object of the present invention is to provide a device that can be easily cleaned and serviced thereby reducing maintenance costs.

Yet another object of the present invention is to provide a deflector device which can be mounted to either the counter or the cooking range in an efficient manner.

Another object of the present invention is to provide a deflector device for a down-draft type range stove which reduces cooking time and increases the life of the ventilator by reducing stress on the ventilator motor.

These and other objects are achieved by providing an adjustable deflector device selectively positionable above the suction exhaust means of a cooking range of the down-draft type comprising a support means having first and second ends, said first end including a first support portion and said second end including a second support portion, said first and second portions being disposed at an angle with respect to each other. The first end is movably attached to the cooking range so that the first support portion is positioned at an angle with respect to the range. The first support portion is rotatable and extendable about its longitudinal axis. The second support portion includes a deflector portion having a width equal to the exhaust means and a length substantially equal to the exhaust means. The second deflector portion is also rotatable and extendable about its longitudinal axis so that the deflector may be selectively positioned above the exhaust means to deflect air-borne matter or other fluid therein.

The present invention is also directed to a cooking range provided with an adjustable deflector means for increasing the efficiency for capturing and exhausting cooking heat and vapors through a ventilator comprising a range top surface provided with at least one heating element disposed on its surface. A suction exhaust means is disposed adjacent to and flush with at least one heating element with the exhaust means having a length and width. A deflector means including support means having first and second ends is provided, the first end includes a first support portion while the second end includes a second support portion. The first and second portions are disposed at an angle with respect to each other. The first end is movably attached to the cooking range so that the first support portion is positioned at an angle with respect to the range top surface. The first support portion is rotatable and extendable about its longitudinal axis. The second support portion includes a deflector portion having a width at least equal to the exhaust means and a length substantially equal to the exhaust means. The deflector portion is rotatable and extendable about its longitudinal axis so that the deflector means may be selectively positioned above the exhaust means to deflect air-borne matter or other fluid therein.

Additional objects, advantages and features of the present invention will become apparent from a consideration of the following specification taken into conjunction with the accompanying drawings.

DETAILED DESCRIPTION OF THE PREFERRED EMBODIMENT

Figure 1:
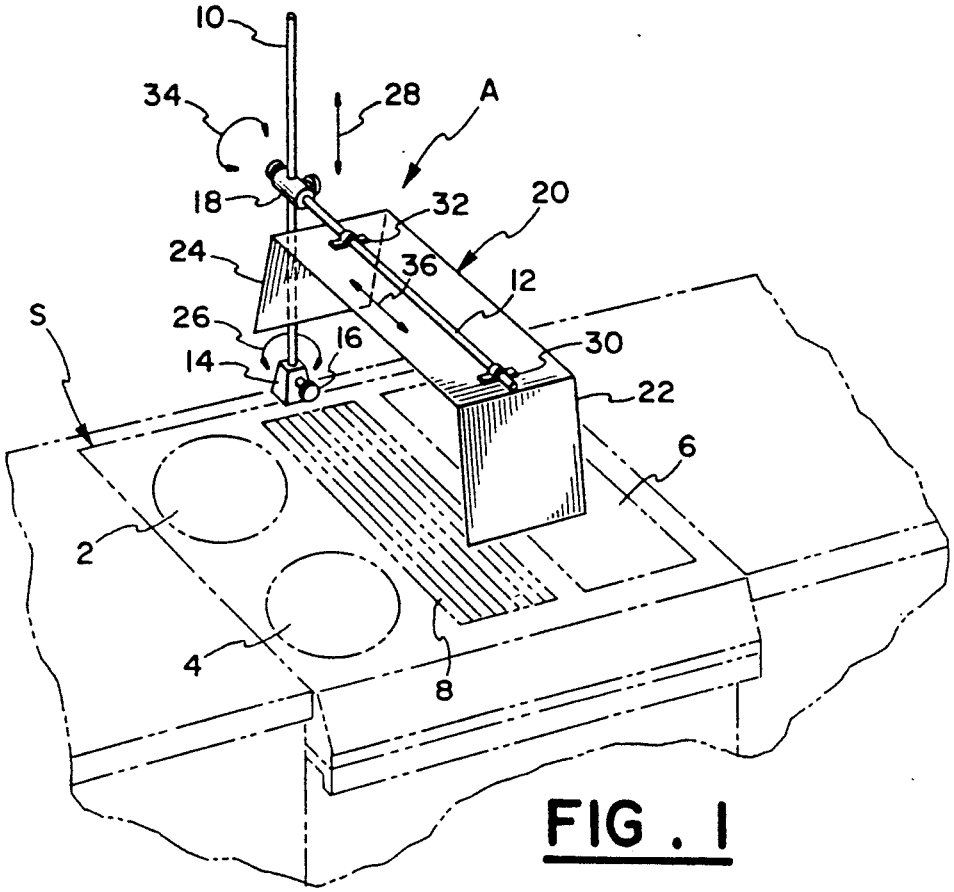
FIG. 1 illustrates a perspective view of the two-piece deflector device according to the present invention when secured to a range stove of the down-draft type as indicated in phantom lines and further including directional lines indicating the various directional adjustments of the device.

Referring to FIG. 1, a down-draft type cooking range S is shown mounted within a conventional counter top and including heating elements 2 and 4 with grill portion 6 and ventilator or exhaust means 8 disposed therebetween. Cooking range S is generally of the type shown and described in U.S. Pat. Nos. 3,596,650 and 3,474,724 both specifications of which are incorporated herein by reference. The range S and others like it may be provided with conventional electrical resistor or gas fired heating elements 2 and 4 or broiler or grill portion 6 in various arrangements. The exhaust means 8 is shown centrally positioned to the heating elements 2 and 4 and grill 6 however other variations are within the scope of the present invention. The exhaust means 8 includes a fan (not shown) which operates to produce a "down-draft" or vacuum that withdraws particles, smoke and heat generated during the cooking process.

The deflector device A comprises a support including a vertically disposed first support portion 10 and a horizontally disposed second support portion 12. The first support portion 10 and the second support portion 12 are shown as comprising rods, but is within the scope of the present invention to provide other configurations so long as first and second support portions 10, 12 are sturdy and provide sufficient rigidity to support the overall device while maintaining integrity.

A support means or swivel stand 14 is mounted to the cooking stove S or counter top and secures the first support portion 10 in a position generally perpendicular to the plane of the cooking stove S. The swivel stand 14 may include an opening through which the first support portion 10 is slidably movable therein. A set screw 16 may be provided to lock or otherwise secure the first support portion 10 within a desired position within swivel stand 14. The swivel stand 14 may be secured to the surface of the counter or stove S in any of a variety of ways including welding, mechanical attachment or adhesive bonding. It is within the scope of the present invention to provide devices other than swivel stand 14 to support or mount the first support portion 10 to the cooking stove S. For example, a tube could be secured to the cooking stove top surface into which the end of the first support portion is inserted. The primary requirement of the support means 14 selected in accordance with the present invention is to ensure that the deflector device A can be mounted in a secure manner while still allowing longitudinal extension and retraction of first support portion 10 and axial rotation about the same axis. This is best illustrated by directional arrows 26 and 28.

Returning now to FIG. 1, the second support portion 12 is shown secured to the first support portion 10 by a clamping device 18. The second portion is preferably similar to the first support portion 10 in construction. The clamping device 18 as generally shown comprises a tube having two passageways extending therethrough at right angles with respect to each other. Each passageway is provided with a set screw. Consequently, the end of the second support portion 12 can be inserted within the clamping device 18 through a first passageway and secured by a set screw while the first support portion 10 is inserted through a second passageway of the clamping device 18 and secured by a separate set screw thereby positioning the first and second support portions 10, 12 at about a right angle with respect to each other. As can be appreciated, other clamping devices are within the scope of the present invention so long as they interconnect the first and second support portions 10 and 12 in a rigid and secure manner while allowing adjustment as will be described.

A deflector shield or portion 20 provided with downwardly extending shroud portions 22, 24 is movably secured to the second support portion 12. As best shown in FIG. 1, the width of the deflector shield 20 is at least equal to the width of the exhaust means 8 while the length of the deflector shield 20 is substantially equal to the length of the exhaust means 8. The deflector shield 20 is secured to the second support portion 12 by hinge or straps means 30 and 32. It is within the scope of the present invention to provide other means for securing the deflector shield 20 to the second support portion 12 so long as the deflector shield 20 is axially rotatable about its longitudinal axis as indicated by arrow 34 yet extendable about its longitudinal axis as indicated by arrow 36. The overall device has multidirectional adjustment of the deflector sheet 20 relative to the exhaust means 8.

In operation, the deflector device A is affixed to the stove S so that the deflector shield 20 may be positioned above the exhaust means 8. Once the exhaust means 8 has been turned on, cooking vapors and smoke are drawn into the exhaust means in a downward direction. The deflector device A is then adjusted in terms of height and angle with respect to the exhaust means 8 so as to modify and improve the flow of vapor and smoke into the exhaust means 8. The deflector device A can be adjusted axially about first support portion 10 and in a manner indicated by arrow 26 to centrally position the shroud over the exhaust means 8 or, if desired, away from exhaust means 8 when the stove is no longer in use. Further, depending upon the speed at which the exhaust means has been set, the deflector can be adjusted by raising or lowering the deflector shield 20 as shown by arrow 28 to increase or decrease the height at which the deflector shield 20 is positioned relative to the exhaust means 8.

Additionally, if only heating elements 2, 4 are only being used during cooking, the deflector shield 20 can be tilted axially about the second support portion 12 and in a manner as shown by arrow 34 towards the operating burners. Finally, the deflector shield 20 can be extended or retracted along its longitudinal axis on second support portion 12 as indicated by arrow 36. The net effect of the multi-directional adjustment of the shroud is to modify the flow of air or smoke into the exhaust means 8 by creating a ceiling above the exhaust means, the angle and positioning of which has been tailored to the speed of the exhaust means and the amount and location of smoke and vapor being generated during cooking.

Figure 2:
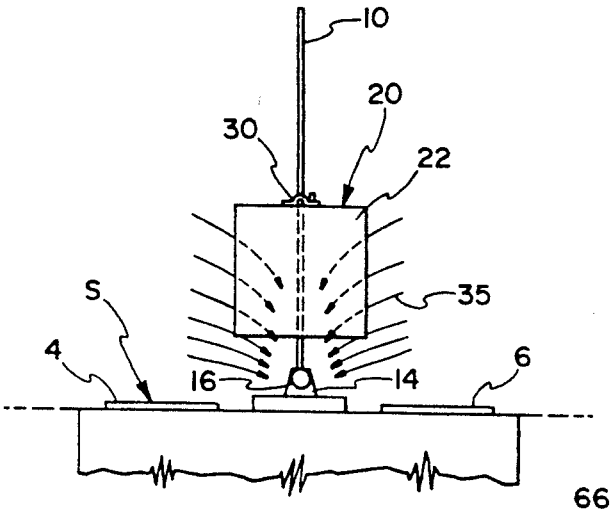
FIG. 2 is a front plan view of the device shown in FIG. 1 including arrows indicating the path of air deflected into the exhaust means of the range top stove.

As best shown in FIG. 2, the deflector device A forces or flattens air into a more lateral direction across both the top surface of the cooking stove S and more importantly heating elements 2, 4 and 6 thereby creating a compressed airflow which moves quickly across the cooking surface. Applicant has found that this increased flow decreases cooking time for food. Applicant believes that by drawing off more of the ambient air surrounding the food into the exhaust means in this manner, the device reduces cooking time by ensuring that the heat generated at the burners is concentrated towards cooking the food rather than dissipation into the surrounding air. The device thus operates in a manner somewhat similar to a convection oven by increasing a continuous draw of air over the food.

Figure 3:
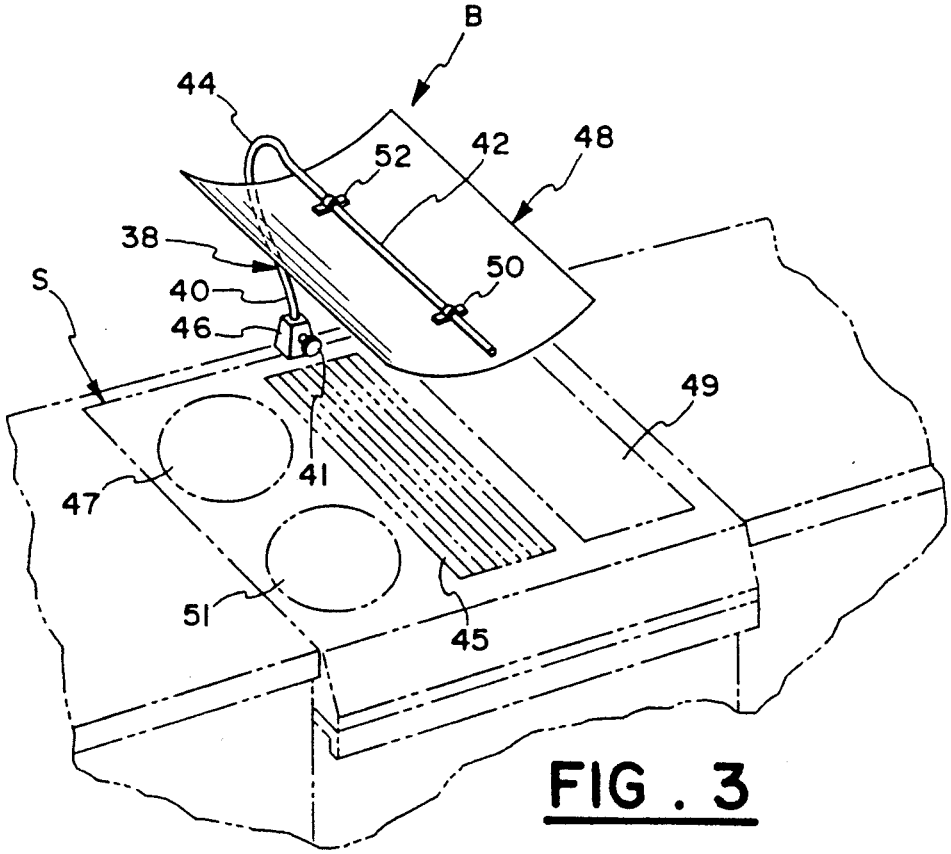
FIG. 3 illustrates a perspective view of an alternative embodiment according to the present invention showing a one-piece deflector device secured to a range stove of the down-draft type as indicated in phantom lines and further including an alternative design of the deflector portion of the device.

Turning now to FIG. 3, an alterative embodiment is illustrated showing a deflector device B having a one piece support 38 including a first support portion 40 generally disposed perpendicular to the surface of the stove S and heating elements 47, 51 and 49. A second support portion 42 is generally disposed at a right angle to the first support portion 40. The first support portion 40 and second support portion 42 are interconnected by a neck portion 44. The one piece support 38 is mounted to a counter top or the surface of the stove S by a swivel stand 46 including set screw 41 and is similar in construction to that described in FIG. 1 so as to provide longitudinal and axial movement of first portion 40. A deflector shield 48 is secured to the second support portion 42 by hinge or strap means 50 and 52. The hinge or strap means 50 and 52 is likewise similar to that described in FIG. 1 and allows the deflector shield 48 to both rotate and extend along its longitudinal axis. In a preferred embodiment, the one piece support 38 is constructed from bendable, heat resistant material such as metal to allow the device to be readily bent about the neck portion 44 and thus provide further adjustment to the angle of the first support portion to the second support portion.

Figure 4:
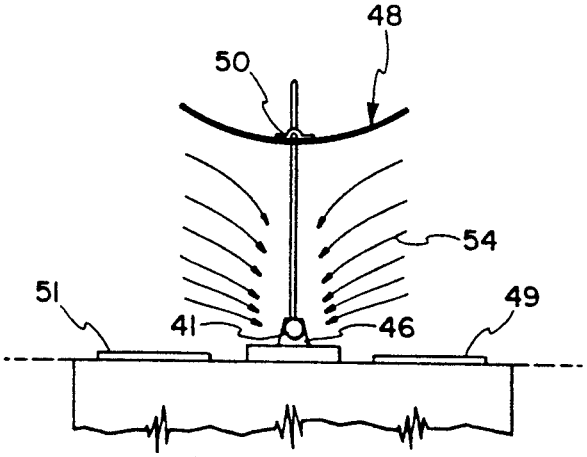
FIG. 4 illustrates a front plan view of the device shown in FIG. 3 including arrows indicating the path of air deflected into the exhaust means of the range top stove.

The surface of deflector shield 48 facing the exhaust means 45 in FIGS. 3 and 4 is convex along its longitudinal axis. This surface modifies the airflow in a manner different than that shown in FIGS. 1 and 2 since the shield 48 lacks shroud portions 22 and 24 and the surface is curved. As best shown in FIG. 4, the convex curvature modifies the airflow 54 into the exhaust means 45 in a manner similar to that shown in FIGS. 1 and 2 by creating a ceiling above the exhaust means 45 thereby increasing flow across the surface of the burners 47, 49 and 51 into the exhaust means 45. The curvature and lack of shrouds however, provides a modification somewhat different than that shown in FIG. 2 by compressing the airflow with a curved surface.

Figure 5:
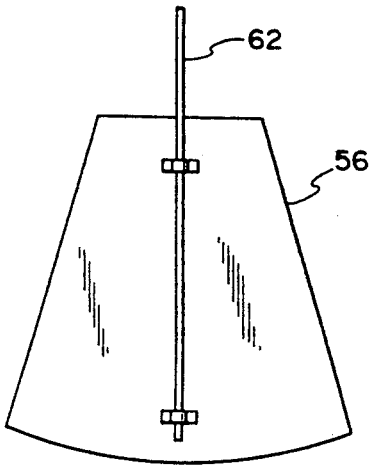
FIG. 5 is a top plan view of an alternative configuration for the deflector portion of the device attached to the second support portion.
Figure 6:
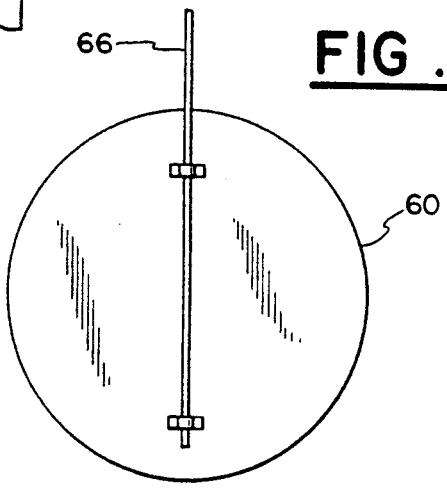
FIG. 6 is a top plan view of an alternative configuration for the deflector portion of the device attached to the second support portion.
Figure 7:
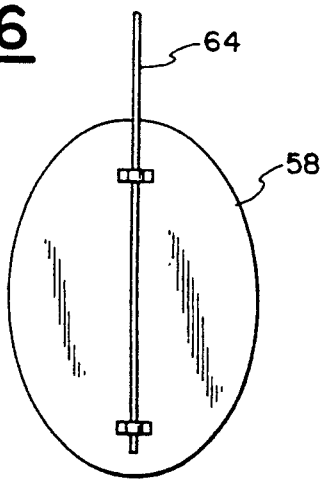
FIG. 7 is a top plan view of an alternative configuration for the deflector portion of the device attached to the second support portion.

Alternative configurations for the deflector shield 48 are shown in FIGS. 5, 6 and 7. FIG. 5 illustrates a fan shaped deflector shield 56, FIG. 6 discloses a circular deflector shield 58 and FIG. 7 discloses an oval deflector shield 60 each of which is attached to second support portions 62, 64 and 66 respectively. Each of the various deflector shields 56, 58 and 60 modifies the flow of vapors and smoke into the exhaust means 8 in a different manner. It is therefore within the scope of the present invention to interchange the various shields depicted in FIGS. 1–7 depending upon the type of vapors, the quantity of smoke or grease generated during cooking or the shape of the exhaust means 8. Applicant has found that by interchanging the various deflector shields, the efficiency of deflector device A can be increased accordingly.

It is also within the scope of the present invention to provide a removable foil cover or wrapper for the deflector shield to trap grease or other particles during use. After a sufficient period of time, the foil wrap may be simply removed from the device to uncover a new foil wrapper ready for use.

Any of a wide variety of materials available in the art can be used in construction of the device according to the present invention. Generally speaking, a material which is fireproof, bendable and heat resistant is preferred. For example, aluminum, copper or other malleable metals and alloys can be used in construction of the support portions or the deflector shield itself. Alternatively, a temperature resistant glass may also be used. The hinge straps 30, 32, 50 and 52 may be substituted with any type of device known in the art that will allow the various deflector shields to be readily interchanged from the second support portion 12 with a minimum of effort. The device may also be provided with a Teflon TM coating allowing the surface to be easily cleaned.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

It is also within the scope of the invention for a vertical rod, or support, to clip or fasten to the approximate center of the trim cover of the ventilator, on top of the cooktop or range, so that the deflector, on top of the rod or support, could rotate in either direction freely, on top of the rod or support.

I claim:

1. An adjustable deflector device selectively positionable above the suction exhaust means of a cooking range of the type where the exhaust means is disposed adjacent to and flush with the heating elements of the cooking range, said deflector comprising:

a) support means having first and second ends, said first end including a first support portion and said second end including a second support portion, said first and second portions being disposed at an angle with respect to each other;

b) said first end movably attached to the cooking range so that said first support portion is positioned at an angle with respect to the range, said first support portion is rotatable and extendable about its longitudinal axis; and c) said second support portion including a deflector portion having a width at least equal to the exhaust means and a length substantially equal to the exhaust means, said deflector portion is rotatable and extendable about its longitudinal axis so that said deflector may be selectively positioned above the exhaust means to deflect air-borne matter or other fluid therein.

2. A deflector device as set forth in claim 1 and wherein:

a) said deflector portion provided with shroud means extending downwardly therefrom towards the exhaust means.

3. A deflector device as set forth in claim 1 and wherein:

a) said deflector portion secured to said second support portion by swivel hinge means for allowing rotational adjustment thereof.

4. A deflector device as set forth in claim 1 and wherein:

a) said deflector portion having a width greater than the width of the exhaust means.

5. A deflector device a set forth in claim 1 and wherein:

a) said deflector portion has a circular configuration.

6. A deflector device as set forth in claim 1 and wherein:

a) said deflector portion has an oval configuration.

7. A deflector device as set forth in claim 1 and wherein:

a) said deflector is convex along its longitudinal axis.

8. A deflector device as set forth in claim 1 and further comprising:

a) adjustable clamp means for interconnecting said first and second support portions.

9. A deflector device as set forth in claim 1 and wherein:

a) said support means is a one-piece unit of bendable material.

10. A deflector device as set forth in claim 1 and further comprising:

a) swivel stand for attaching said first end to the range.

11. A deflector device as set forth in claim 1 and wherein:

a) said first and second portions are disposed at about a 90° right angle.

12. A cooking range provided with an adjustable deflector means for increasing the efficiency in capturing and exhausting cooking heat and vapors comprising:

a) a range top surface provided with at least one heating element disposed on its surface;

b) suction exhaust means disposed adjacent to and flush with said at least one heating element, said exhaust means having a length and a width;

c) deflector means including support means having first and second ends, said first end including a first support portion and said second end including a second support portion, said first and second portions being disposed at an angle with respect to each other;

d) said first end movably attached to said cooking range so that said first support portion is positioned at an angle with respect to said range top surface, said first support portion rotatable and extendable about its longitudinal axis; and e) said second support portion including a deflector portion having a width at least equal to said exhaust means and a length substantially equal to said exhaust means, said deflector portion rotatable and extendable about its longitudinal axis so that said deflector means may be selectively positioned above said exhaust means to deflect air-borne matter or other fluid therein.

13. A cooking range as set forth in claim 12 and wherein:

a) said deflector portion provided with a shroud means extending downwardly therefrom towards said exhaust means.

14. A cooking range as set forth in claim 12 and wherein:

a) said deflector portion secured to said second support portion by swivel hinge means for allowing rotational adjustment thereof.

15. A cooking range as set forth in claim 12 and wherein:

a) said deflector portion having a width greater than the width of said exhaust means.

16. A cooking range as set forth in claim 12 and wherein:

a) said deflector portion has a circular configuration.

17. A cooking range as set forth in claim 12 and wherein:

a) said deflector portion has an oval configuration.

18. A cooking range as set forth in claim 12 and wherein:

a) said deflector has a convex surface along its longitudinal axis.

19. A cooking range as set forth in claim 12 and further including:

a) adjustable clamp means for interconnecting said first and second support portions.

20. A cooking range as set forth in claim 12 and wherein:

a) said support means comprises a one-piece unit of bendable material.

* * * * *